US006826941B2

(12) United States Patent
Plesh, Sr.

(10) Patent No.: US 6,826,941 B2
(45) Date of Patent: Dec. 7, 2004

(54) ROLLER APPARATUS WITH IMPROVED HEIGHT ADJUSTABILITY

(76) Inventor: Ronald L. Plesh, Sr., 31 Hemlock Hill, Orchard Park, NY (US) 14127

( * ) Notice: Subject to any disclaimer, the term of this patent is extended or adjusted under 35 U.S.C. 154(b) by 136 days.

(21) Appl. No.: 10/339,819

(22) Filed: Jan. 10, 2003

(65) Prior Publication Data

US 2003/0101786 A1 Jun. 5, 2003

Related U.S. Application Data

(63) Continuation-in-part of application No. 09/751,663, filed on Dec. 29, 2000, now Pat. No. 6,532,788.

(51) Int. Cl.[7] ..... B21B 13/14

(52) U.S. Cl. ..... 72/241.2; 72/241.4; 72/252.5; 492/1

(58) Field of Search ..... 72/237, 241.2, 72/241.4, 246, 252.5; 422/1, 2, 16; 100/160; 384/58

(56) References Cited

U.S. PATENT DOCUMENTS

| | | | | |
|---|---|---|---|---|
| 2,294,970 A | | 9/1942 | Fagerstrom | |
| 2,479,974 A | | 8/1949 | Sendzimir et al. | |
| 2,776,586 A | | 1/1957 | Sendzimir | |
| 3,147,648 A | | 9/1964 | Sendzimir | |
| 3,691,810 A | | 9/1972 | Tadeusz | |
| 3,709,019 A | | 1/1973 | Sendzimir | |
| 4,064,728 A | | 12/1977 | Dobrovolsky | |
| 4,289,013 A | | 9/1981 | Hunke | |
| 4,295,355 A | | 10/1981 | Sendzimir | |
| 5,007,152 A | | 4/1991 | Tomizawa et al. | |
| 5,179,851 A | | 1/1993 | Turley et al. | |
| 5,193,377 A | | 3/1993 | Sendzimir et al. | |
| 5,308,307 A | * | 5/1994 | Morel et al. | 492/1 |
| 5,421,184 A | | 6/1995 | Sendzimir et al. | |
| 5,471,859 A | | 12/1995 | Sendzimir et al. | |
| 5,481,895 A | | 1/1996 | Sendzimir et al. | |
| 5,483,812 A | | 1/1996 | Dempsey | |
| 5,943,895 A | | 8/1999 | Lemper | |
| 6,286,355 B1 | | 9/2001 | Figge et al. | |
| 6,408,668 B1 | * | 6/2002 | Figge et al. | 72/241.4 |
| 6,532,788 B2 | | 3/2003 | Plesh, Sr. | |

* cited by examiner

*Primary Examiner*—Ed Tolan
(74) *Attorney, Agent, or Firm*—James C. Simmons

(57) ABSTRACT

A roller assembly for use as a back-up roller for work rolls. The roller assembly comprises an axle, a roller rotatably mounted on the axle, a plurality of bearing elements rotatably positioned between the axle and roller, at least one bushing which is eccentric relative to the axle and which is fixedly mounted on the axle by a dowel which passes through holes in the axle and eccentric bushing, and a housing for the bushing. The eccentric bushing is rotatable for translating the roller in a radial direction thereof. In order to rotate the bushing in one of opposite circumferential directions, force is applied to a respective one of a pair of terminal ends of grooving, preferably a single groove, which extends circumferentially in a radially outer surface of the eccentric bushing and which is adapted to allow unimpeded movement of adjustment screws in apertures in the housing to adjustably engage the grooving terminal ends thereby to maximize roller translation effected by the apertures and screws and positions of the terminal ends. The eccentric bushing passages (and/or the axle passages) through which the dowel passes are oblong to allow each bushing to independently move circumferentially relative to the other bushing within the limits of the oblong passages, to enable compensation for slight misalignment between the work roll and the back-up roller for the purpose of achieving near perfect contact.

23 Claims, 4 Drawing Sheets

ROLLER APPARATUS WITH IMPROVED HEIGHT ADJUSTABILITY

This application is a continuation-in-part of application Ser. No. 09/751,663, filed Dec. 29, 2000, now U.S. Pat. No. 6,532,788 the disclosure of which is incorporated herein by reference.

The present invention relates generally to roller apparatus such as, for example, back-up rollers used to support work rolls.

Work rolls are used in tandem sets to shape metal through compressive forces. The supporting back-up rollers tend to have a relatively larger diameter than the work rolls. Back-up rollers must be capable of applying very high forces, as much as 300,000 pounds of force.

Conventional back-up rollers comprise a bearing in which the axle is received in the inner race and the outer race is received in the roller. Bearing elements such as ball or cylindrical members are rotatably received between the races so that the roller is rotatable relative to the axle. Since there are size constraints on the rollers, the wall thickness of each of the inner and outer races for back-up roller bearings is conventionally limited to typically no more than about ½ inch. Bearings, for example, for cam followers and bearing wheels, have been provided wherein the wall thicknesses of the inner and outer races have been in excess of 1 inch. The rigidity of a race is related to its effective wall thickness (which includes the thickness of an axle or roller to which it is rigidly mounted), and the bearing capacity is a function of the rigidity of the races. Thus, the capacity of such conventional back-up rollers is limited by the rigidity of the least rigid of the races.

Back-up bearings have been provided wherein the inner race is mounted over an axle and has a variable thickness ranging between about ¾ inch and about 1 1/16 inch and wherein the outer race serves as the roller and has a variable thickness in excess of about 3 inches and the surface of which has a shore hardness of 78 to 83.

One type of back-up roller heretofore provided by Applicant to a customer comprises two spherical roller bearings with an inner race fitted to an axle and an outer race fitted to an outer shell or roller composed of AISI 4140 heat-treated steel having a Rockwell C hardness of 45. Both the bearing life and the shell life were however considered unacceptable. In order to improve the shell life and also hopefully the bearing life, the customer requested that the shell be made instead of cast 420 stainless steel having a Rockwell C hardness of 50. While this did improve the shell life, the bearing life nevertheless remained unacceptable to the customer.

Back-up rollers are placed at spaced positions both circumferentially about (from overhead and from the floor) and axially along the work rolls. Each back-up roller must be accurately positioned, both top to bottom and left to right, and custom precision grinding is required to achieve the necessary accuracy during every changeover.

As the back-up rollers wear and their outer diameters accordingly decrease, they do not bear as hard against the work rolls with the result that the work rolls are undesirably more prone to deflect. When this occurs, it has been necessary with conventional back-up rollers to replace a worn roller with a new one. It is, however, considered desirable to increase the useful life of the back-up rollers so that they may need replacement less often.

In order to extend the useful life of such a back-up roller, in accordance with the invention disclosed and claimed in the parent application, the height (distance from the back-up roller axle to the back-up roller circumference or radially outer surface) thereof was adjustable by rotating an eccentric mount through which the axle is disposed and thereby translating the roller in a radial direction thereof. In order to rotate the eccentric bushing, a pair of circumferential slots were provided in the eccentric bushing, and force was applied to the eccentric bushing at ends respectively of the slots to push the eccentric bushing in opposite circumferential directions respectively.

FIGS. 1 to 3 illustrate generally at 10 an assembly of a pair of back-up rollers 12 which are used to support work rolls in accordance with the invention disclosed and claimed in the parent application. It should be understood that an assembly may include only one, three, or any other number of rollers 12. Work rolls 15 are rolls which perform work on material which is passed between the work rolls, for example, flattening a sheet of metal. In order to perform the work, suitable force must be applied to the material, and back-up rollers 12 apply force to the work rolls 15 to aid them in performing the work.

The assembly 10 includes a housing 14 comprising a generally rectangular base plate 16 to opposite sides of which are attached, such as by welding or other suitable means, a pair of side plates 18 each having a pair of semi-circular openings or arches, illustrated at 20, in its upper edge for the mounting of the rollers 12 respectively. Illustrated at 29 are a plurality (the assembly is shown to have three) of beams at the ends and center of the side plates 18 respectively and about midway of the height thereof, each beam 29 extending between and suitably attached to the side plates 18 such as, for example, by welding for bracing the housing 14. A pair of cap plates 22 are attached to the upper edge of each of the side plates 18 each by means of a pair of fasteners 24 the shanks of which are received in apertures 23 in the respective cap plate 22 and which threadedly engage threaded apertures 27 in the respective side plate 18 or by other suitable means. The fasteners 24 may, for example, be socket head cap screws the heads of which are received in counterbores in the cap plates 22. Slotted (for receiving a screwdriver) plugs 25 are screwed into the upper portions of the bores to cover and protect the bolts 24. The bottoms of the threaded apertures 27 are suitably vented, and the vent holes (not shown) are closed by vent plugs 31. Each cap plate 22 has a semicircular opening or arch, illustrated at 26, in its lower edge which is complementary to the opening 20 in the respective side plate 18 to provide a circular passage, illustrated at 28, wherein the pair of passages 28 on one side of the housing are in alignment with the pair of passages 28 on the other side of the housing.

A bushing 30 is received in each of the passages 28 to rotatably (frictionally) engage the respective side plate 18 and cap plate 22 and extends axially inwardly a small distance beyond the inner side surfaces thereof. The axially inner corners of the cap and side plates 22 and 18 respectively are suitably chamfered, such as at an angle of about 45 degrees, as illustrated at 32 and 34 respectively. The bushing 30 has a circumferential ridge 33 extending from its radially outer surface which frictionally engages complementary notches 36 and 38 in the chamfered corners 32 and 34 respectively to locate the position axially of the bushing 30 and prevent its movement axially out of the assembly 10.

An axle 40 is received within each respective pair of bushings 30 and is attached thereto to prevent relative rotation therebetween by a dowel 74. By "dowel" is meant to include other suitable attachment devices such as a pin or key. The dowel 74 is received in a bore, illustrated at 75, which extends diametrically across the axle 40 in each end portion thereof and in bores, illustrated at 77, in the respective bushing 40.

Rotatably positioned about the axially central portion of the radially outer surface of the axle 40 are a plurality of circumferential rings or groups of roller bearing elements 42, preferably cylindrical. For example, there may be 8 side-by-side groups each having 22 roller bearing elements positioned circumferentially about the axle 40. A thin flat washer-shaped spacer member, illustrated at 44, is positioned between each group and the adjacent group of roller bearing elements 42. The radially inner axle-engaging edge of each spacer member 44 is scalloped such as by a plurality of half-moon cutouts, similarly as illustrated at 145 in FIG. 6, spaced circumferentially about the inner edge or by other suitably shaped cutouts to allow grease passage along the length of the axle.

Encircling all of the roller bearing elements 42 is a bushing or sleeve 46. For the purposes of this specification and the claims, the sleeve 46 is part of the roller 12. Thus, the roller 12 is considered to be a laminated or two-piece roller comprising the outer member 11 (which may also be referred to herein as the roller) and the sleeve 46. The sleeve is received within the bore 48 of the roller outer member 11. As discussed with reference to FIGS. 4 to 6, the roller 12 may alternatively be of a single piece construction or may otherwise be suitably constructed.

Each end of the bore 48 has an increased diameter to define a cutout, illustrated at 50, in the radially inner and axially outer surfaces of the roller outer member. An end plate 52 is received circumferentially about the axle 40 between each bushing 30 and the roller bearing elements 42 and respective sleeve 46 and is press-fit or frictionally received in the respective cutout 50 to thereby fix the position axially of the roller 12 and rotates with the roller 12. A groove is provided in the radially inner surface of each end plate 52 to receive grease to seal the radially inner surface thereof. While not shown in FIGS. 1 to 3, the groove is similar to the groove illustrated at 153 in FIG. 5. A suitable seal 84, such as an axial lip seal, is provided to extend circumferentially about each bushing 30 on the axially inner end portion thereof and with a lip 86 which engages the respective end plate 52. In addition to supporting the rolling elements 42 from skewing and coming out, the end plates 52 are provided to increase roller rigidity and thus roller stability, provide hardened surfaces to receive thrust, and to provide a hardened smooth finish for the seal 84 to rub against and thereby have longer seal life.

At 54 are bores, for example, 4 bores circumferentially spaced in each of the end walls of the axle 40 for receiving a spanner wrench for purposes of assembly. At 56 is a hole for use in driving the axle for grinding.

For each roller 12, a grease passage or bore, illustrated at 58, extends from an opening in the lower outer surface of the base plate 16 through the base plate height then partially through the height of a side plate 18 to a point of termination or blind end. A pipe plug 60 closes each grease passage opening. Access to the forward grease passage is through the opening. Since the grease passage opening for the rear roller assembly may be inaccessible, a grease passage, illustrated at 76, extends horizontally over a portion of the base plate length and connects with the passage 58 for the rear roller assembly for supply of grease thereto. The passage 76 is closable at one end in an end wall of the base plate 16, which may be a more accessible location, by a pipe plug 78 and extends beyond the corresponding grease passage 58 to a tapped hole 80 used to receive a hold-down fastener (not shown) for connecting the assembly to a base, the passage 76 providing a vent as well as a means of lubricating the hold-down fastener.

Another grease passage, illustrated at 62, receives grease from passage 58 adjacent the blind end and extends therefrom toward the axis, illustrated at 64, of the axle 40 and to an outlet from the side plate 18. An adjoining grease passage, illustrated at 66, receives grease from passage 62 and extends radially through the bushing 30 to an outlet in the radially inner surface thereof. An adjoining grease passage, illustrated at 68, in the axle 40 receives grease therefrom and delivers it to a radially central passage, illustrated at 70, of the axle 40. The grease is delivered for lubricating the roller bearing elements 42 via a passage, illustrated at 72, which extends radially outwardly in opposite directions from an axially central point of passage 70. A threaded portion, illustrated at 82, of the passage 70 adjacent each dowel 74 receives a suitable pipe plug (not shown) to close the radially central grease passage 70.

As previously discussed, the use of a conventional bearing having inner and outer races and rolling elements therebetween interposed between the axle and roller would be limited in race thickness, the typical race thickness being about ½ inch. Therefore, the races conventionally used are eliminated so that the rolling bearing elements 42 are disposed between the axle 40 and roller 12 which accordingly function as an inner race and an outer race respectively. This allows increased wall thickness to the "bearing races" for increased rigidity and accordingly increased bearing capacity. Thus, the roller wall radial thickness, illustrated at 149 for the back-up roller shown in FIG. 5, may be, for example, about 1½ inch, and the axle wall radial thickness, illustrated at 155 for the back-up roller shown in FIG. 5, may be, for example, about 1½ inch to thereby provide what is considered to be about double the capacity than would normally be provided if conventional bearings having thinner races were used. The terms "radial" and "radially" are defined, for the purposes of this specification and the claims, unless otherwise specified, as a direction toward or away from the axis 64 of axle 40, and the terms "axial" and "axially" are meant to refer to direction parallel to the axis 64. The thickness 155 would be equal to the radius of a section of the axle 40 taken in a radial plane if the axle does not contain a central passage such as lubrication passage 70 therein. The thickness 149 is meant to include the total thickness of parts of a laminated roller such as parts 11 and 46 of the roller of FIGS. 1 to 3. Preferably, the thicknesses 149 and 155 are each at least about 1 inch in order to provide adequate bearing capacity.

In order to extend the back-up roller life, the bushing 30 is eccentric. Thus, when the back-up roller is worn as well as during installation, the bushing is rotated to translate the roller 12 radially to a position where it is closer to the respective work roll and in a desirable position, as when unworn, to bear against the respective work roll with sufficient force so that deflection of the work roll does not occur. In accordance with FIGS. 1 to 3, the bushing 30 is shown to be rotatable by means of a pair of circumferential slots, illustrated at 88, therein extending in opposite circumferential directions to blind or closed ends, illustrated at 90. Set screws 92 (only one shown), which may, for example, be half dog set screws, are threadedly receivable in threaded apertures, illustrated at 94, in the housing cap plate 22. These apertures 94 extend in directions circumferentially and radially inwardly of the eccentric bushing 30 toward the blind ends 90. A ball element 96 is provided in each aperture 94 ahead of the set screw 92 to afford point contact with the bushing 30 to prevent binding. The set screws 92 thus bear against the ball elements 96 which in turn bear against the blind ends to push the eccentric bushing 30 circumferentially. By pushing on the bushing 30 at the blind ends 90 by means of the set screws 92 and ball elements 96, the bushing 30 is rotatable through a small angular distance.

In addition to effecting eccentric bushing placement so that it stayed tight and did not damage the housing and then to confirm that it would remain tight over a long period of time (years), a major problem has been insufficiency of the amount of height adjustment. It is also important that, after any height adjustment, all of the roller elements share the load. Modifications made to the roller of FIGS. 1 to 3 for the purpose of solving, inter alia, these problems are discussed hereinafter.

As initially installed, the roller height was adjustable through about 0.008 inch. It was discovered that the end plates (which enclose the rolling elements at the ends and which are fitted in cutouts in the roller) were cracking. This was corrected by increasing the radiuses of end plate corners and corresponding cutout corners from about 1/32 inch to about 3/32 inch and by press fitting (instead of slip-fitting) the end plates into position in order to reduce distortion and flexing of the roller. A bevel was also added to the roller to reduce stresses in the roller corners.

In order to improve the bearing life, the back-up rollers were made with the inner race serving as the axle and the outer race serving as the roller, and the outer race was made of a two-piece or laminated construction comprising an outer member of cast 420 stainless steel having a Rockwell C hardness of 50 (so as to not mark the work rolls) and a harder inner sleeve of AISI 52100 bearing steel having a Rockwell C hardness of 60. When test results showed that, although the back-up roller assembly life had been improved, the outer members were wearing and in some cases fatiguing (cracks in corners of end plates) too rapidly, they were improved by making the roller as a single piece of D2 tool steel having a Rockwell C hardness of 60 (option 1) for higher wear resistance as well as strength and hardness. Additional test results in the year 2000 indicated that, because of the increased hardness of the D2 tool steel material, the life of the work rolls was reduced. It is now believed that by constructing the roller inner sleeve of AISI 52100 bearing steel having a Rockwell C hardness of 62 and the roller outer member of forged 420 stainless steel having a Rockwell C hardness of 52 (option 2), ideal wear of both the outer and inner members of the roller as well as the work roll should now be achieved. It was also discovered that some applications are of such a severe nature that the benefit of the robust construction of the solid D2 roller (option 1) would outweigh the reduced life (increased wear) of the work roll, and, accordingly, it has been decided to offer both options 1 and 2 to customers.

It was also discovered that the rolling or bearing element spacers were too tight against the axle and not adequately sharing the load and that the grease was not flowing well from the middle to the outside rolling elements. This was remedied by scalloping (making semi-circular cutouts) the circular edges defining the inner diameters of the spacers and by increasing the spacer outer diameter to give back surface area lost due to the scalloping. The flatness of the spacers was increased to reduce the amount of acceptable wavyness (for tighter tolerance).

It was further found that the eccentric bushing was not staying tight enough within its housing, and this was remedied by making the housing cap out of armor plate (1½ inch thick) instead of standard carbon steel.

It was also found that the amount of eccentric adjustment was insufficient especially in view of the need to adjust for inaccuracies in set-up. The angle, illustrated at 21 in FIG. 1, of the pair of slots 88 used for adjustment of the eccentric bushing was increased from 46 to 73 degrees to obtain the necessary amount of roller adjustment. When it was found that this did not achieve the desired amount of roller adjustment since adjusting set screws 92 were oriented generally at tangents to the slots respectively, the angle 21 was reduced to about 50.54 degrees.

An improvement made in the year 2000 is the provision of an increased length to a closed-off grease slot to 1⅜ inch so as to open it up.

The achievable amount of roller translation or height adjustment of the eccentric bushing, which is desirably about plus or minus 0.018 inch or more (at least about 0.015 inch), was still unduly limited, i.e., only about plus or minus 0.012 inch. Thus, there was some cause other than slot length for the limited height adjustment.

Moreover, the eccentric bushings at opposite ends of the roller may not adequately share the load if the housing dimensions at the opposite ends are off by as much as perhaps 0.001 inch, i.e., while one side of the roller may hit or engage the work roll, there may still be a gap between the roller and work roll on the other side with the result that the one side may undesirably bear all of the load.

It is accordingly an object of an aspect of the present invention to achieve adequate height adjustment for the back-up roller.

It is another object of the present invention to compensate for such small inaccuracies in the housing or otherwise so as to cause both bushings to share the load equally.

In order to achieve adequate height adjustment for the back-up roller, in accordance with the present invention, a portion of the eccentric bushing between the slots 88, which was found to be interfering with the movement of the adjustment set screws into the slots, was removed by extending the slots to each other thus making the pair of slots 88 into one single slot.

In order to compensate for small inaccuracies in the housing or otherwise so as to cause both bushings to share the load equally, each eccentric bushing has holes in which the dowel is received which are oblong so as to have a greater length circumferentially of the bushing than the diameter of the dowel 174 so as to allow some circumferential movement of each eccentric bushing independently of the other bushing.

The above and other objects, features, and advantages of the present invention will be apparent in the following detailed description of the preferred embodiments thereof when read in conjunction with the accompanying drawings wherein the same reference numerals denote the same or similar parts throughout the several views.

DETAILED DESCRIPTION OF THE PREFERRED EMBODIMENTS

Figure 2:
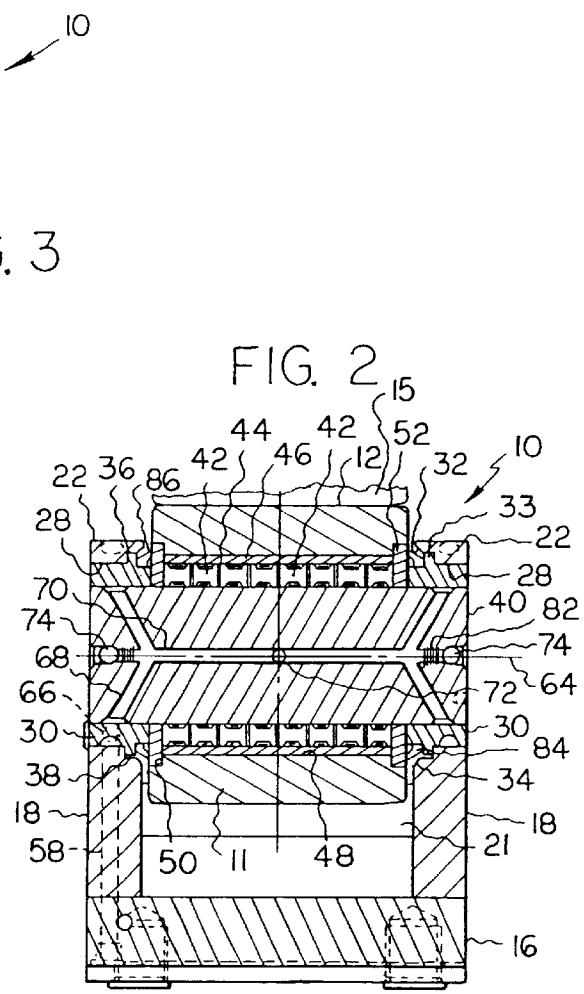
FIG. 2 is a sectional view thereof taken along lines 2—2 of FIG. 1.
Figure 3:
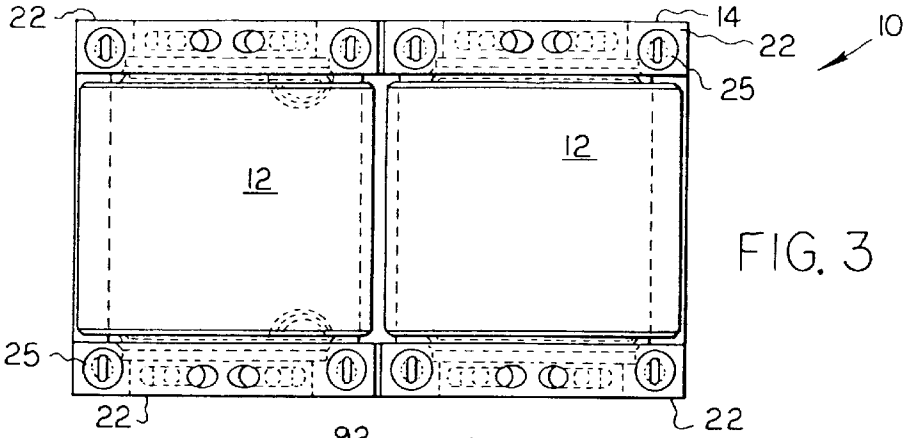
FIG. 3 is a plan view thereof.
Figure 1:
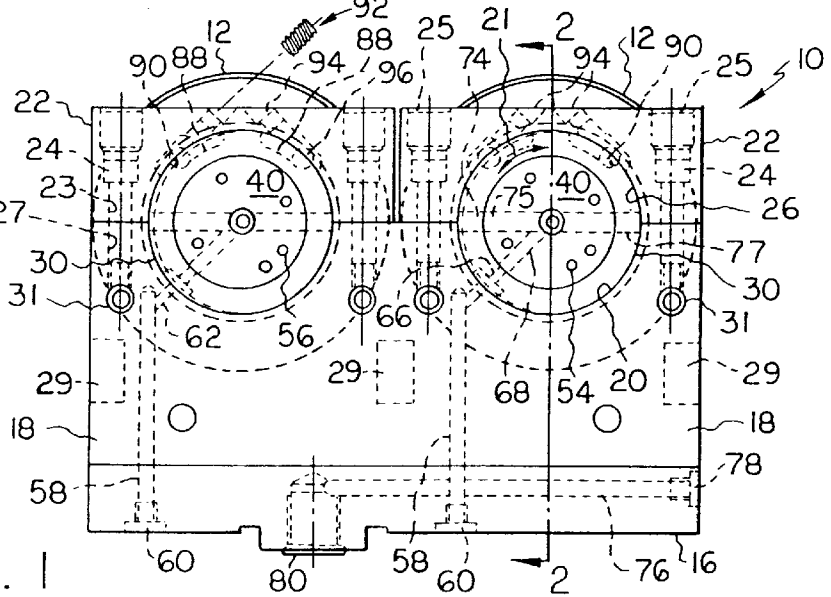
FIG. 1 is a side elevation view of apparatus which embodies the invention disclosed and claimed in the parent application.

The present invention is illustrated in FIGS. 4 to 10, which, as previously discussed, contain improvements over the above discussed back-up roller of FIGS. 1 to 3. The heretofore discussion of FIGS. 1 to 3 is applicable to the hereinafter discussion of FIGS. 4 to 10, except as otherwise indicated. Therefore, the invention illustrated in FIGS. 4 to 10 will now be discussed with comparisons being made with the back-up roller of FIGS. 1 to 3, as appropriate.

Figure 4:
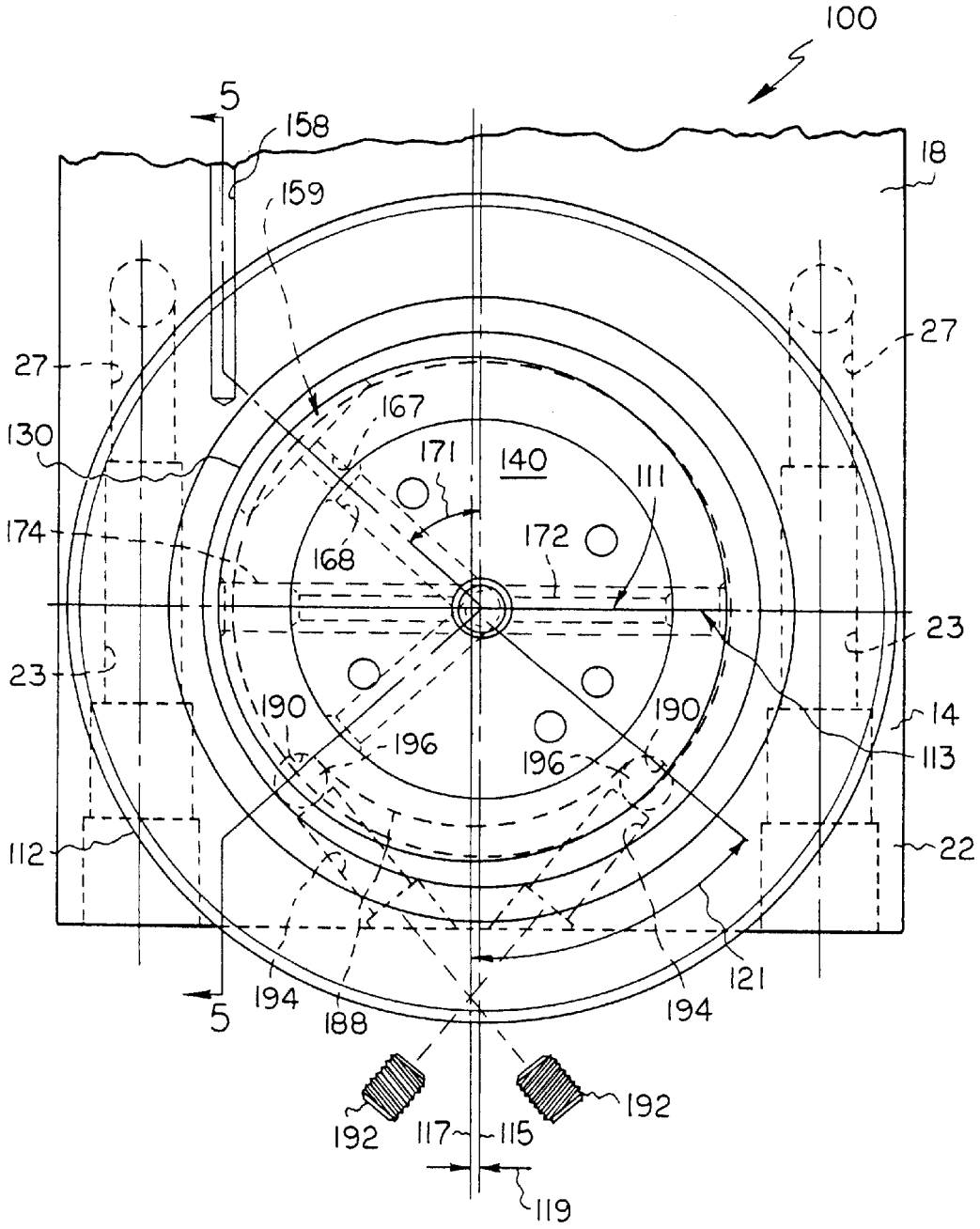
FIG. 4 is a partial side elevation view, with housing portions removed for purposes of clarity, of apparatus which embodies the present invention.
Figure 5:
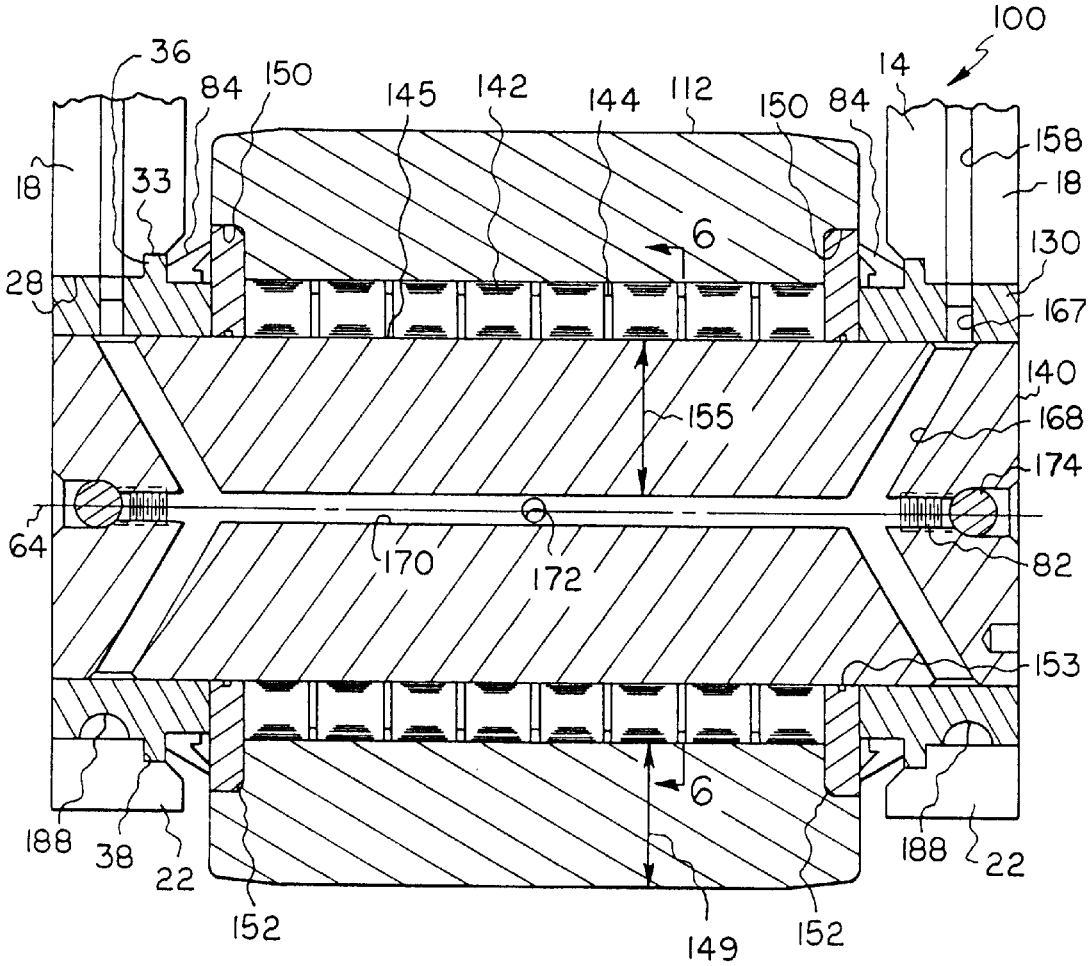
FIG. 5 is a sectional view thereof taken along lines 5—5 of FIG. 4.
Figure 6:
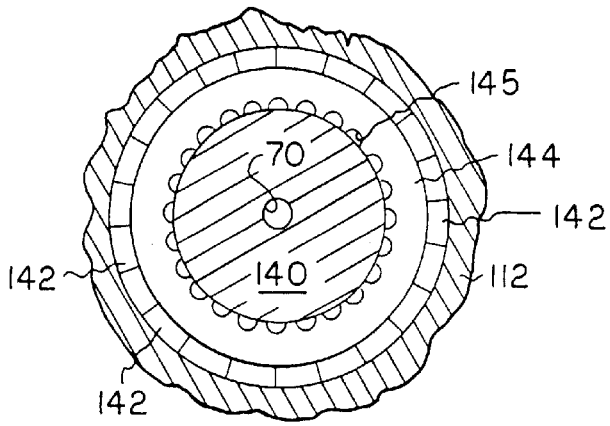
FIG. 6 is a sectional view thereof taken along lines 6—6 of FIG. 5.

Referring to FIGS. 4 and 5, there is shown generally at 100 a back-up roll apparatus in accordance with the present invention. It should be noted that the back-up roller illustrated in FIGS. 1 to 3 is shown upside-down from the back-up roller of the present invention which is illustrated in FIGS. 4 to 6. Since about half of the back-up rollers are normally hung from overhead, the roller assembly would normally about half of the time be orientated with the base plate being the uppermost part of the assembly, as shown in FIGS. 4 and 5.

The apparatus 100 includes an axle or inner race 140, which is similar to axle 40 and the end portions of which are received within eccentric bushings 130 and fixed thereto against relative movement therebetween by dowels 174 similarly as axle 40 is fixedly received within bushings 30. The eccentric bushings 130 are in turn rotatably received within the circular passages 28 defined by the end caps 14 and side plates 18. Each bushing 130 is eccentric in that the axis of the circular passage in which the axle 140 is received is offset form the circular passage, illustrated at 28, in which the bushing is rotatably received.

It should however be understood that, in accordance with the present invention, the bushings 130 (as well as 30) may otherwise be eccentric relative to the axle 140 or 40 respectively, i.e., eccentric to the entire axle 140 or 40 or to the axle portion, illustrated at 320 in FIG. 10, upon which the roller 112 is bearingly received, as illustrated and described more fully hereinafter with respect to FIG. 10. Thus, for purposes of this specification and the claims, the phrase "eccentric relative to the axle" is defined to mean eccentric to an axle portion which supports the roller.

Rotatably positioned about the axially central portion of the radially outer surface of the axle or inner race 140 are a plurality of groups of roller bearing members 142, similarly as the roller bearing members are provided about the axle 40. The rolling bearing members 142, which are illustrated schematically in FIG. 6, are preferably cylindrical, but may otherwise be suitably shaped. A spacer member, illustrated at 144, is positioned between each circumferential group of bearing members 142 and the adjacent circumferential group of bearing members 142. The bearing members 142 are rotatably received between the inner race 140 and the roller or outer race 112. Each end of the roller 112 has a cutout, illustrated at 150, similar to cutout 50, in the radially inner roller corner. An end plate 152 is received circumferentially about the axle 140 between each bushing 130 and the roller bearing members 142 and the spacer member 144 and is frictionally received (press fit) in the respective cutout 150 to thereby fix the position axially of the roller 112 and for the other purposes as described for end plates 52.

Unlike the roller illustrated in FIGS. 1 to 3, the roller 112 of the apparatus 100 of the present invention (FIGS. 4 to 9) is not laminated and thus does not include a sleeve radially inwardly thereof, with the result that the thickness (radially) of the single-part roller 112 is increased over that of the roller part 11, and the distance radially over which the cutout 150 extends is accordingly increased. As previously discussed, the sleeve (46 in FIGS. 1 to 3) is eliminated from between the roller 112 and the roller elements 142, and the roller 112 is preferably composed of D2 tool steel, which has a hardness (Rockwell C hardness of 60) sufficient to properly support the rolling elements 142, and the increased wall thickness 149 aids in roller stability and bearing life. However, if desired, a sleeve or bushing, similar to sleeve 46 in FIGS. 1 to 3, may be provided between the roller 112 and rolling elements 142 in order to reduce marking of the work rolls, in which case the roller is preferably made of forged 420 stainless steel having a Rockwell C hardness of 52 and the sleeve is preferably made of AISI 52100 bearing steel having a Rockwell C hardness of 62, as previously discussed.

Illustrated at 111 and 113 are index marks on the non-eccentric or circular axle 140 and the eccentric bushing 130 respectively. The thickness of the eccentric bushing 130 varies over its circumference from a maximum on the left side (as seen in FIG. 4) to a minimum on the right side. The centerpoints at the index marks 111 and 113 of the axle 140 and eccentric bushing 130 are illustrated at 115 and 117 respectively. In order to afford a desirable amount of roller height adjustment, the distance between the centerpoints 115 and 117, illustrated at 119, may be, for example, about 0.065 plus or minus 0.005 inch. Thus, by rotating the eccentric bushing 130 with the axle 140 fixed thereto, the axle 140 may be translated radially so as to be positioned closer to or farther from work rolls.

When it was discovered that an increased slot length (about 73 degrees) did not improve the height adjustment ability as desired, it was determined that if the slot length were too long, both adjustment set screws, due to being oriented generally tangentially to the slot, could not satisfactorily be tightened at the same time without undesirably adding additional balls or the like. In this regard, it should be noted that maximum roller translation per a specific amount of eccentric rotation occurs when the centerline 115 is about midway of the slot and decreases as the eccentric is rotated in either direction from this mid-position. Accordingly, in order that tightening of both set screws could satisfactorily be achieved while also allowing the amount of adjustment to be maximized, the slot length was decreased to that shown in FIGS. 1 and 4, i.e., to a slot length (distance angularly between line 117 and the slot blind end 190), illustrated at 121 in FIG. 4, of about 50.54 degrees plus or minus 0.25 degrees in the eccentric bushing 130. However, it should be understood that such a slot length is to be considered as exemplary and not for purposes of limitation.

It was, however, discovered that, irregardless of the changes in the slot length, the amount of roller translation or height adjustment of the eccentric bushing, which is desirably about plus or minus 0.018 inch, remained unduly limited, i.e., only about plus or minus 0.012 inch. Thus, there was some cause other than slot length for the limited height adjustment.

Indeed, it was discovered that a portion of the eccentric bushing between ends of the two separate slots was interfering with the movement of the adjustment set screws into the slots. In order to achieve adequate height adjustment for the back-up roller, in accordance with the present invention, as shown in FIG. 4 of the drawings, a portion of the eccentric bushing between the slots, which was the portion found to be interfering with the movement of the adjustment set screws into the slots, was removed, i.e., the grooving was adapted to allow unimpeded movement of the screws in the apertures thereby to maximize roller translation effected by the apertures and screws and positions of the terminal ends by removal of any portion of the eccentric bushing between ends of the pair of slots which interferes with screw movement so as to allow such unimpeded screw movement.

In accordance with a preferred embodiment, all of the material between the separate slots is removed thus merging the separate slots into one single slot. Thus, preferably, each eccentric bushing 130 has a single slot (or groove or step), illustrated at 188, extending, in the radially outer surface thereof, between two opposed blind or closed ends 190.

Preferably, the angular slot length 121 (which it should be noted is half of the distance angularly between the blind ends 190 of the single slot) is between about 50 and 70 degrees, more preferably between about 50 and 55 degrees, so that it may be long enough to achieve the desired roller translation of up to about 0.018 inch yet not be so long as to prevent the set screws from being satisfactorily tightened. Similarly as for the embodiment of FIGS. 1 to 3, a threaded aperture, illustrated at 194, is provided in the respective cap plate 22 and directed to extend circumferentially and radially inwardly toward the respective blind end 190, and a set screw 192 threadedly receivable therein to bear against a ball element 196 received therein to make point contact with the blind end 190 to push the eccentric bushing 130 circumferentially, in one direction circumferentially at one blind end 190 and in the other direction circumferentially at the other blind end 190, to adjustably effect translation of the axle 140 radially.

Figure 9:
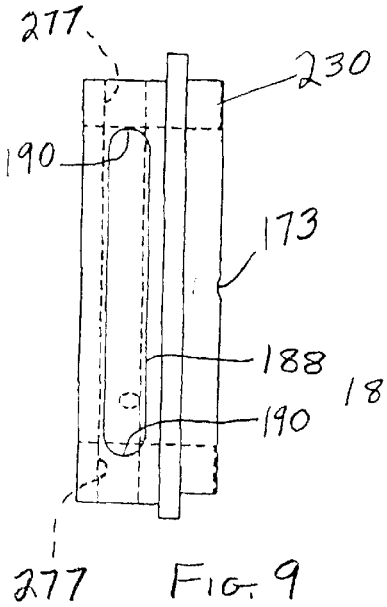
FIGS. 8 and 9 are front and side elevation views respectively thereof.
Figure 7:
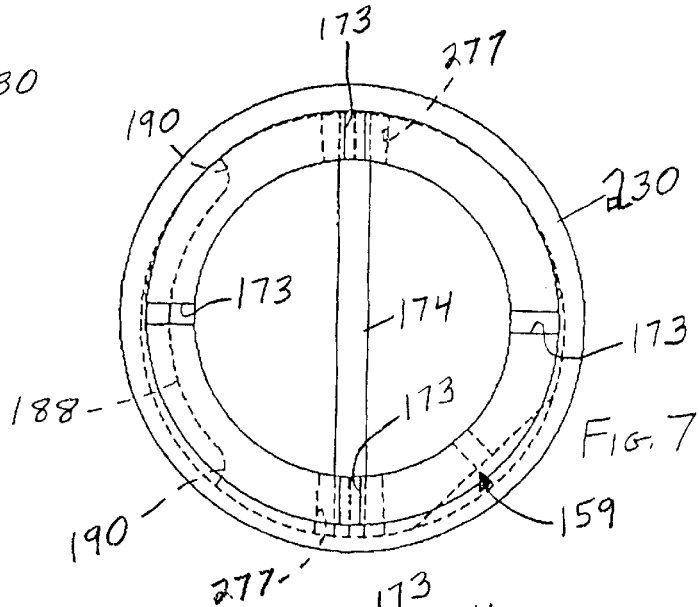
FIG. 7 is a plan view of an improved bushing for the apparatus of FIGS. 4 to 6.
Figure 8:
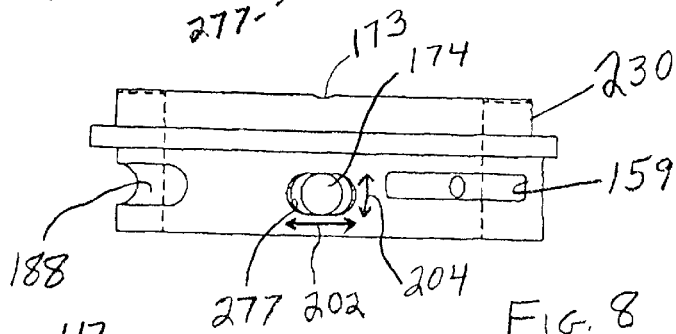

The following example is provided for exemplary purposes only and not for purposes of limitation. The assembly 100 of FIGS. 4 and 5 may, for example, have an axle length of about 10.485 inches, an axle diameter of about 3 13/16 inches, a roller length of about 7 1/16 inches, roller outer and inner diameters of about 8.313 and 5.1 inches respectively, an eccentric bushing outer diameter of about 5.126 inches, a thickness and radial height of the end plates 152, which ate armor plated, of about ⅜ inch and 1 inch respectively, a thickness of spacers 144 of about 1/16 inch, and an axle dowel diameter of about ½ inch. The eccentric bushing ridge 33 has a thickness of about ¼ inch and is spaced from the axially outer end of the eccentric bushing a distance of about 0.998 inch and from the centerline of the grease passage 158 a distance of about 0.375 inch. The end caps 22 and side plates 18 each have a thickness of about 1½ inch. The grease passage 158 has a diameter of about ¼ inch, and its centerline is spaced a distance of about 2½ inches from the vertical centerplane of the axle. The grease slot pocket, illustrated at 159, in the eccentric bushing at its interface with the side plate 18 has a width and length of about ¼ inch and 1⅜ inch respectively, desirably large enough to insure that the grease passage is not closed off when the eccentric bushing and axle are rotated to a different angular position during height adjustment. From the grease slot 159, grease passages 167 and 168 extend through the eccentric bushing and axle respectively at an angle, illustrated at 171, of about 46 degrees to the radially central grease passage 170. Ditches or cavities (generally v-shaped grooves), as illustrated at 173 for FIGS. 7 to 9, are provided to extend across the face of the eccentric bushing 230 to allow pass-through of grease to lubricate and to reduce pressure, as is conventionally done in the art. Each ditch 173 may, for example, be about 0.03 inch deep and about 0.25 inch wide. The ball elements 196 have a diameter of about 13.494 mm, and the slot 188 is milled to a diameter of about 0.56 inch. The set screws 192 are ½ inch diameter half dog set screws.

In order to adjustably translate the roller 112 radially toward or away from a work roll, the eccentric bushing 130 is rotated in a circumferential direction by use of one of the set screws to apply force to the blind end 190 which corresponds to the desired direction of rotation of the bushing by (1) unscrewing the other set screw 192 so as to allow the rotation to occur, then (2) screwing the set screw 192 corresponding to the desired direction of rotation inwardly to bear on the ball element 96 and thereby push against the respective blind end 190 thereby pushing the eccentric bushing circumferentially, then (3) tightening the other set screw so that both set screws are tight to lock the bushing in the re-set position. The apparatus of the present invention as described herein is provided to allow rotation through about 30 degrees in either direction to achieve a roller translation of up to about 0.018 inch (at least about 0.015 inch).

The eccentric bushings 130 at opposite ends of the roller may undesirably not adequately share the load if the housing dimensions at the opposite ends are off by as much as perhaps 0.001 inch, i.e., while one side of the roller may hit or engage the work roll, there may still be a gap between the roller and work roll on the other side with the result that the one side may undesirably bear all of the load. In order to compensate for such small inaccuracies in the housing or otherwise so as to cause both bushings to share the load equally, referring to FIGS. 7 to 9, in accordance with a preferred embodiment of the present invention, a preferred eccentric bushing, illustrated generally at 230, which is similar to bushing 130, is provided at each end of the roller wherein the bushing holes, illustrated at 277, in which the dowel 174 is received are oblong so as to have a greater length, illustrated at 202, circumferentially of the bushing than the diameter of the dowel 174 and a height, illustrated at 204, which is preferably equal substantially to the diameter of the dowel 174. For example, each hole 277 may have a length 202 of about 0.75 inch and a height 204 of about 0.5005 inch to accommodate a dowel 174 having a diameter of about 0.5 inch. This allows the eccentric bushings 230 to adjust individually within a small range, allowing each bushing 230 to independently move circumferentially relative to the other bushing within the limits of the oblong holes 277 to enable compensation for slight misalignment between the work roll and the back-up roller for the purpose of achieving near perfect contact. Alternatively, the axle holes 75 may be similarly oblong.

Figure 10:
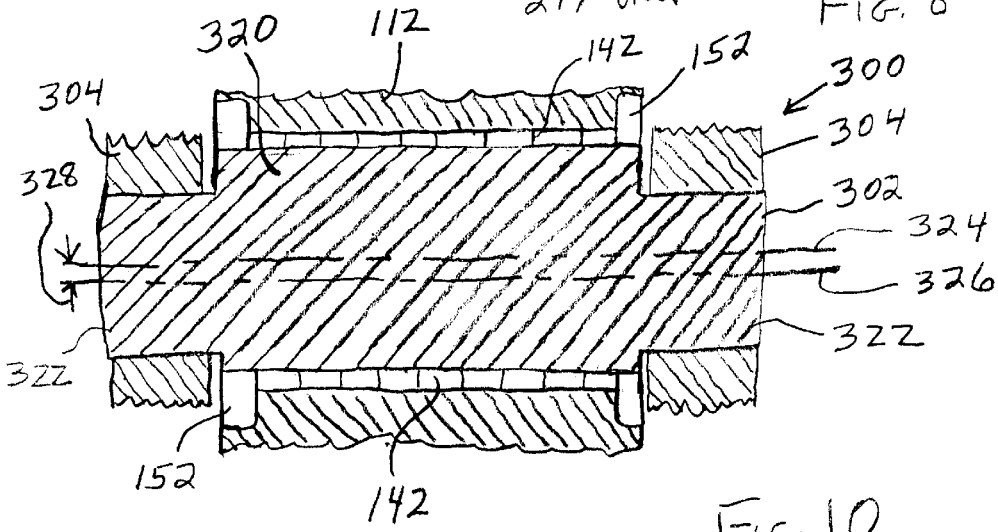
FIG. 10 is a partial schematic sectional view of roller apparatus in accordance with another embodiment of the present invention.

Referring to FIG. 10, there is illustrated partially and schematically generally at 300 roller apparatus including an axle 302 to which is fixedly secured at opposite ends thereof bushings 304, similarly as discussed for FIGS. 1 to 9, for rotating the axle 302 by rotation of the bushings 304. The axle 302 has a first or central cylindrical portion 320 upon which the roller 112 is rotatably mounted by means of the bearing members 142 and end plates 152 in a manner as previously discussed for FIGS. 1 to 9. The axle 302 also has a pair of axially outer second cylindrical portions 322 upon which the bushings 304 are mounted respectively. Except as shown in FIG. 10 and discussed herein, the roller apparatus 300 is identical or similar to roller apparatus in FIGS. 1 to 9.

The second portions 322 are seen to be smaller in diameter than the first portion 320. The first portion has a longitudinal axis illustrated at 324. The second portions 322 have a common longitudinal axis, illustrated at 326, which is offset from axis 324 a suitable distance radially illustrated at 328. This distance 328 can be determined in accordance with the discussion of FIGS. 1 to 9, using principles commonly known to those of ordinary skill in the art to which this invention pertains. As a result, the first portion 320 is eccentric relative to the second portions 322 as well as the bushings 304, and, accordingly, the bushings 304, which also have common axis 326, are eccentric relative to the first portion 320 and therefore are eccentric relative to the axle 302 (in accordance with the previously discussed definition of "eccentric relative to the axle"). Similarly as discussed for FIGS. 1 to 9, this eccentricity effects translation of the roller 112 radially when the axle 302 is rotated by rotation of the bushings 304. If desired, the bushings 304 may also be eccentric relative to the second portions 322 to which they are secured.

It should be understood that, while the present invention has been described in detail herein, the invention can be embodied otherwise without departing from the principles thereof, and such other embodiments are meant to come within the scope of the present invention as defined by the appended claims.

What is claimed is:

1. A roller assembly comprising an axle, a roller rotatably mounted on said axle, at least one bushing which is eccentric relative to said axle and which is mounted on said axle to effect rotation of said axle by rotation of said bushing, at least one means for rotating said bushing in opposite circumferential directions respectively for translating said roller in a radial direction of said roller, said at least one rotating means comprising a single circumferentially extending groove which is located in a radially outer surface of said bushing and which has a pair of terminal ends adapted for application of force against each of said terminal ends for rotating said bushing in opposite circumferential directions respectively.

2. A roller assembly according to claim 1 wherein said bushing is mounted on said axle to effect play circumferentially between said bushing and said axle.

3. A roller assembly according to claim 2 further comprising passages in said bushing and said axle and a dowel receivable in said passages for mounting said bushing on said axle, and at least one of said passages sized to allow play circumferentially between said bushing and said axle.

4. A roller assembly according to claim 3 wherein each of said passages of said bushing has a width in a direction circumferentially of said bushing which is greater than a diameter of said dowel to allow relative movement circumferentially of said bushing between said bushing and said dowel.

5. A roller assembly according to claim 1 further comprising a housing member in which said bushing is rotatably received, said at least one rotating means further comprising a pair of threaded apertures in said housing member, and screws in said threaded apertures respectively in position for engaging and applying force to said terminal ends respectively for rotating said bushing.

6. A roller assembly comprising an axle, a roller rotatably mounted on said axle, at least one bushing which is eccentric relative to said axle and which is mounted on said axle to effect rotation of said axle by rotation of said bushing, at least one single circumferentially extending groove which single groove is located in a radially outer surface of said bushing and which has a pair of terminal ends adapted for application of force against each of said terminal ends for rotating said bushing in opposite circumferential directions respectively for translating said roller in a radial direction of said roller.

7. A roller assembly according to claim 6 wherein said bushing is mounted on said axle to effect play circumferentially between said bushing and said axle.

8. A roller assembly comprising an axle, a roller rotatably mounted on said axle, at least one bushing which is eccentric relative to said axle and which is mounted on said axle to effect rotation of said axle by rotation of said bushing, circumferentially extending grooving located in a radially outer surface of said bushing and which has a pair of terminal ends which are adapted for application of force against each of said terminal ends for rotating said bushing in opposite circumferential directions respectively for translating said roller in a radial direction of said roller, a housing member in which said bushing is rotatably received, a pair of threaded apertures in said housing member, and screws in said threaded apertures respectively in position for engaging and applying force to said terminal ends respectively for rotating said bushing, wherein said grooving is adapted to allow unimpeded movement of said screws in said apertures thereby to maximize roller translation effected by the apertures and screws and positions of the terminal ends.

9. A roller assembly according to claim 8 wherein said bushing is mounted on said axle to effect play circumferentially between said bushing and said axle.

10. A roller assembly comprising an axle, a roller rotatably mounted on said axle, at least two axially spaced bushings which are eccentric relative to said axle, said bushings mounted on said axle to effect rotation of said axle by rotation of said bushings and to effect play circumferentially between at least one of said bushings and said axle, each said bushing being rotatable for translating said roller in a radial direction of said roller.

11. A roller assembly according to claim 10 further comprising at least one single circumferentially extending groove for effecting rotation of at least one of said bushings in opposite circumferential directions respectively, said single groove located in a radially outer surface of said at least one bushing and having terminal ends adapted for application of force against each of said terminal ends for rotating said at least one bushing in opposite circumferential directions respectively.

12. A roller assembly according to claim 10 comprising circumferentially extending grooving located in a radially outer surface of said at least one bushing and which has a pair of terminal ends which are adapted for application of force against each of said terminal ends for rotating said at least one bushing in opposite circumferential directions respectively for translating said roller in a radial direction of said roller.

13. A roller assembly according to claim 12 further comprising a housing member in which said at least one bushing is rotatably received, a pair of threaded apertures in said housing member, and screws in said threaded apertures respectively in position for engaging and applying force to said terminal ends respectively for rotating said at least one bushing, wherein said grooving is adapted to allow unimpeded movement of said screws in said apertures thereby to maximize roller translation effected by the apertures and screws and positions of the terminal ends.

14. A roller assembly according to claim 10 comprising passages in said at least one bushing and said axle and a dowel receivable in said passages for mounting said at least one bushing on said axle, and at least one of said passages sized to effect play circumferentially between said at least one bushing and said axle.

15. A roller assembly according to claim 14 wherein each of said passages of said at least one bushing has a width in a direction circumferentially of said at least one bushing which is greater than a diameter of said dowel to allow relative movement circumferentially of said at least one bushing between said at least one bushing and said dowel.

16. A roller assembly according to claim 15 wherein each of said at least one bushing passages has a dimension axially of said at least one bushing which is substantially equal to the diameter of said dowel.

17. A roller assembly comprising an axle having a first portion and at least one second portion, a roller rotatably mounted on said first portion of said axle, a bushing which is mounted to said at least one second portion of said axle so that said axle rotates as said bushing is rotated, said at least one second portion of said axle being eccentric relative to said first portion of said axle whereby to effect translation of said first portion of said roller radially when said second portion of said axle is rotated, and said bushing being rotatable for rotating said at least one second portion of said axle thereby translating said first portion of said roller in a radial direction of said roller.

18. A roller assembly according to claim 17 further comprising circumferentially extending grooving located in a radially outer surface of said bushing and which has a pair of terminal ends which are adapted for application of force against each of said terminal ends for rotating said bushing in opposite circumferential directions respectively for translating said first portion of said roller in a radial direction of said roller.

19. A roller assembly according to claim 18 wherein said grooving comprises a single circumferentially extending groove which has both of said pair of terminal ends.

20. A roller assembly according to claim 19 further comprising an other bushing which is eccentric relative to said axle and which is mounted to an other second portion of said axle so that said axle rotates as said other bushing is rotated, said bushings mounted on said axle to effect rotation of said axle by rotation of said bushings and to effect play circumferentially between at least one of said bushings and said axle, each of the bushings being rotatable for translating said roller in a radial direction of said roller.

21. A roller assembly according to claim 18 further comprising a housing member in which said bushing is rotatably received, a pair of threaded apertures in said housing member, and screws in said threaded apertures respectively in position for engaging and applying force to said terminal ends respectively for rotating said bushing, wherein said grooving is adapted to allow unimpeded movement of said screws in said apertures thereby to maximize roller translation effected by the apertures and screws and positions of the terminal ends.

22. A roller assembly according to claim 21 further comprising an other bushing which is eccentric relative to said axle and which is mounted to an other second portion of said axle so that said axle rotates as said other bushing is rotated, said bushings mounted on said axle to effect rotation of said axle by rotation of said bushings and to effect play circumferentially between at least one of said bushings and said axle, each of the bushings being rotatable for translating said roller in a radial direction of said roller.

23. A roller assembly according to claim 17 further comprising an other bushing which is eccentric relative to said axle and which is mounted to an other second portion of said axle so that said axle rotates as said other bushing is rotated, said bushings mounted on said axle to effect rotation of said axle by rotation of said bushings and to effect play circumferentially between at least one of said bushings and said axle, each of the bushings being rotatable for translating said roller in a radial direction of said roller.

* * * * *